US006534905B2

(12) United States Patent
Ha et al.

(10) Patent No.: US 6,534,905 B2
(45) Date of Patent: Mar. 18, 2003

(54) COLOR SELECTION APPARATUS FOR A COLOR CATHODE RAY TUBE

(75) Inventors: Kuen-Dong Ha, Sungnam (KR); Dong-Hwan Kim, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/983,609

(22) Filed: Oct. 25, 2001

(65) Prior Publication Data

US 2002/0060515 A1 May 23, 2002

(30) Foreign Application Priority Data

Nov. 17, 2000 (KR) ..... 2000-68595

(51) Int. Cl.[7] ..... H01J 29/80
(52) U.S. Cl. ..... 313/402; 313/407
(58) Field of Search ..... 313/402, 407

(56) References Cited

U.S. PATENT DOCUMENTS

| | | | | |
|---|---|---|---|---|
| 5,111,107 | A | 5/1992 | Kume et al. | |
| 5,416,380 | A | 5/1995 | Horiuchi | |
| 5,550,428 | A | 8/1996 | Kume et al. | |
| 2001/0009349 | A1 * | 7/2001 | Tanaka et al. | 313/402 |

* cited by examiner

*Primary Examiner*—Vip Patel
(74) *Attorney, Agent, or Firm*—Robert E. Bushnell, Esq.

(57) ABSTRACT

A color selection apparatus for a cathode ray tube (CRT) is disclosed. The color selection apparatus includes a frame having a pair of supporting members disposed in parallel and spaced away from each other and a pair of elastic members disposed between and coupled to the supporting members, and a mask coupled to the supporting members and provided with a plurality of beam-passing apertures. Each of the elastic members is formed in a continuously nonlinear-shape in its longitudinal direction.

19 Claims, 6 Drawing Sheets

COLOR SELECTION APPARATUS FOR A COLOR CATHODE RAY TUBE

CLAIM OF PRIORITY

This application makes reference to, incorporates the same herein, and claims all benefits accruing under 35 U.S.C. §.119 from an application entitled COLOR SELECTION APPARATUS FOR CATHODE RAY TUBE filed with the Korean Industrial Property Office on Nov. 17, 2000 and there duly assigned Ser. No. 2000-68595.

BACKGROUND OF THE INVENTION

1. Technical Field

The present invention relates to a color selection apparatus for a color cathode ray tube, and more particularly, to a color selection apparatus that can be effectively associated with a flat screen panel for a cathode ray tube.

2. Related Art

As screens of cathode ray tubes (CRTs) have become larger, flat screen panels have been developed to improve the definition of images realized at a peripheral portion of the large screens. Accordingly, color selection apparatuses employed to realize color in cathode ray tubes have also been flattened so that they can be properly associated with the flat screen panels.

A color selection apparatus can include a pair of U-shaped elastic members and a flat mask. The flat mask is provided with a large number of beam-passing apertures. The U-shaped elastic members apply tension to the flat mask. Such a color selection apparatus can be mounted inside a flat screen panel to select a color from electron beams emitted from an electron gun, for a cathode ray tube.

As the cathode ray tubes have become larger, an effort to reduce their weight has been made, but the U-shaped elastic members have a structural disadvantage when their weight is reduced. Specifically, when a U-shaped elastic member receives an outer force, opposite comers (that is, the bent portions) of the U-shaped elastic member receive stress higher than that applied to other portions due to its structural characteristics. Accordingly, the elastic member is apt to be deformed, as stress is not uniformly distributed thereon. This results in the mis-landing of the electron beams, thereby deteriorating the definition of the cathode ray tube.

Efforts have been made to improve flat color selection apparatuses. Exemplars of recent efforts in the art include U.S. Pat. No. 5,416,380 to Horiuchi, entitled COLOR SELECTION MECHANISM FOR CATHODE RAY TUBE AND ARM MEMBER FOR THE SAME, issued on May 16, 1995, U.S. Pat. No. 5,550,428 to Kume et al., entitled FRAME STRUCTURE OF APERTURE GRILLE WITH HIGHER LONG-SIDE FRAMES, issued on Aug. 27, 1996, and U.S. Pat. No. 5,111,107 to Kume et al., entitled GRID APPARATUS FOR A COLOR CATHODE RAY TUBE WHICH ELIMINATES VIBRATION OF THE GRIDS, issued on May 5, 1992.

While these recent efforts provide advantages, I note that they fail to adequately provide an efficient, convenient, improved color selection apparatus for a color cathode ray tube.

SUMMARY OF THE INVENTION

The present invention has been made in an effort to solve the above-described problems, and others. It is an objective of the present invention to provide a color selection apparatus that is designed to contribute to the reduction in the weight of a cathode ray tube (CRT) having a flat screen panel.

It is another objective of the present invention to provide a color selection apparatus that is designed such that uniform stress is distributed thereon, thereby preventing deformation.

To achieve the above objectives and others, the present invention provides a color selection apparatus for a cathode ray tube, the color selection apparatus comprising a frame having a pair of supporting members disposed in parallel and spaced away from each other, and a pair of elastic members disposed between and coupled to the supporting members; and a mask coupled to the supporting members and provided with a plurality of beam-passing apertures, wherein each of the elastic members is formed in a continuously nonlinear-shape in its longitudinal direction.

Preferably, each of the elastic members is formed in an arc-shape or a semi-elliptical-shape. Preferably, each of the elastic members is formed of a solid rod or a tube. A lateral section of the elastic member is formed in a square-shape, preferably.

Further, each of the supporting members preferably comprises a first plate coupled to an elastic member, and a second plate extending from the first plate at a predetermined angle and being coupled to the mask, wherein the second plate is disposed on an identical curvature line extending from a curvature line of the elastic member.

According to another aspect of the present invention, a cathode ray tube comprises a panel on which a phosphor screen is formed; a funnel connected to the panel; a neck connected to the funnel; and a color selection apparatus disposed inside the panel to select electron beams emitted from an electron gun, the color selection apparatus comprising a frame having a pair of supporting members disposed in parallel and spaced away from each other and a pair of elastic members disposed between and coupled to the supporting members, and a mask coupled to the supporting members and provided with a plurality of beam-passing apertures. Each of the elastic members is formed in a continuously nonlinear-shape in its longitudinal direction.

According to still another aspect of the present invention, a color selection apparatus for a color cathode ray tube comprises a frame having a pair of supporting members disposed in parallel and spaced away from each other and a pair of elastic members disposed between and coupled to the supporting members, each of the elastic members having a central section having a first curvature radius and end sections that are adjacent to the central section having a second curvature radius different from the first curvature radius; and a mask coupled to the supporting members and provided with a plurality of beam-passing apertures.

Preferably, the curvature radius of the central section is about 800 to 10,000 millimeters (mm), and it is further preferably that the first curvature radius is greater than the second curvature radius.

To achieve these and other objects in accordance with the principles of the present invention, as embodied and broadly described, the present invention provides a color selection apparatus for a cathode ray tube, the apparatus comprising: a pair of supporting members; a pair of elastic members, each elastic member being disposed between and connected to said supporting members, said elastic members being formed in a continuously nonlinear shape; and a mask being coupled to said supporting members, said mask forming a plurality of beam-passing apertures.

To achieve these and other objects in accordance with the principles of the present invention, as embodied and broadly described, the present invention provides a cathode ray tube, comprising: a panel having an inner surface with a phosphor screen formed at said inner surface; a funnel being connected to said panel; a neck being connected to said funnel; and a color selection apparatus being disposed adjacent to said inner surface of said panel to select electron beams-emitted from an electron gun, said color selection apparatus comprising: a first supporting member; a second supporting member; a pair of elastic members, each one of said elastic members being disposed between and connected to said first and second supporting members, each one of said elastic members being formed in a continuously nonlinear shape in a direction from said first supporting member to said second supporting member; and a mask being coupled to said first and second supporting members, said mask forming a plurality of beam-passing apertures.

To achieve these and other objects in accordance with the principles of the present invention, as embodied and broadly described, the present invention provides a color selection apparatus for a color cathode ray tube, the apparatus comprising: a frame, comprising: a pair of supporting members being disposed in parallel and spaced away from each other; and a pair of elastic members being disposed between and coupled to said supporting members, each one of said elastic members having a central section and two end sections adjacent to said central section, said central section having a first curvature radius, said two end sections having a second curvature radius different from said first curvature radius; and a mask being coupled to said supporting members and provided with a plurality of beam-passing apertures.

To achieve these and other objects in accordance with the principles of the present invention, as embodied and broadly described, the present invention provides an apparatus, comprising: a plurality of supporting members, said plurality of supporting members including at least a first supporting member and a second supporting member; at least one elastic member, said elastic member being disposed between and connected to said first and second supporting members, said at least one elastic member being formed in a continuously nonlinear shape extending in a direction from said first supporting member to said second supporting member; and a mask being coupled to said first and second supporting members, said mask forming a plurality of beam-passing apertures.

To achieve these and other objects in accordance with the principles of the present invention, as embodied and broadly described, the present invention provides a method, comprising: connecting at least one elastic member to a first supporting member and to a second supporting member, said at least one elastic member being formed in a continuously nonlinear shape extending in a direction from said first supporting member to said second supporting member; and coupling a mask to said first and second supporting members, said mask forming a plurality of beam-passing apertures.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE PREFERRED EMBODIMENTS

While the present invention will be described more fully hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Illustrative embodiments of the invention are described below. In the interest of clarity, not all features of an actual implementation are described. In the following description, well-known functions or constructions are not described in detail since they would obscure the invention in unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure.

Figure 13:
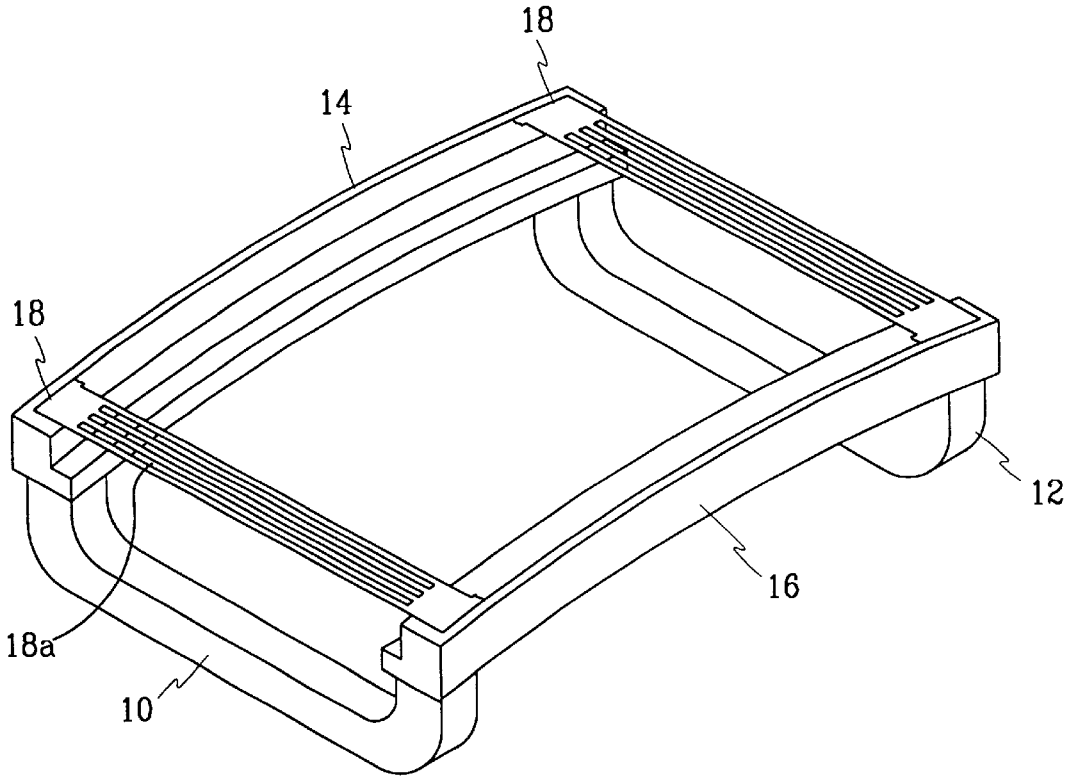
FIG. 13 is a perspective view of a color selection apparatus for a cathode ray tube.

FIG. 13 shows a color selection apparatus that has some features which exhibit undesirable characteristics. FIG. 13 does not depict the present invention. In FIG. 13, there is shown a color selection apparatus that comprises a pair of elastic members 10 and 12, a pair of supporting members 14 and 16 coupled to the elastic members 10 and 12, and a flat mask 18 mounted on the supporting members 14 and 16. The elastic members 10 and 12 are U-shaped and arranged in a lateral direction at a predetermined distance from each other. The supporting members 14 and 16 are arranged in a longitudinal direction, and opposite ends of each of the supporting members 14 and 16 are welded on the elastic members 10 and 12. The flat mask 18 is provided with a large number of beam-passing apertures 18*a*, and it is welded on the supporting members 14 and 16. The elastic members 10 and 12 apply a predetermined tension to the flat mask 18 through the supporting members 14 and 16. Such a color selection apparatus is mounted inside the flat screen panel to select a color from electron beams emitted from an electron gun.

The U-shaped elastic members 10 and 12 exhibit undesirable characteristics. The color selection apparatus shown in FIG. 13 has U-shaped elastic members 10 and 12. As cathode ray tubes have become larger, there have been efforts to reduce the weight of the cathode ray tubes and efforts to reduce the weight of U-shaped elastic members. Unfortunately, the U-shaped elastic members of FIG. 13 have a structural disadvantage when their weight is reduced. Specifically, when a U-shaped elastic member receives an outer force, opposite comers (that is, the bent portions) of the U-shaped elastic member receive stress higher than that applied to other portions due to its structural characteristics. Accordingly, the elastic member is apt to be deformed, as stress is not uniformly distributed thereon. This results in the mis-landing of the electron beams, thereby deteriorating the definition of the cathode ray tube.

Preferred embodiments of the present invention will now be described in detail with reference to the accompanying drawings.

Figure 1:
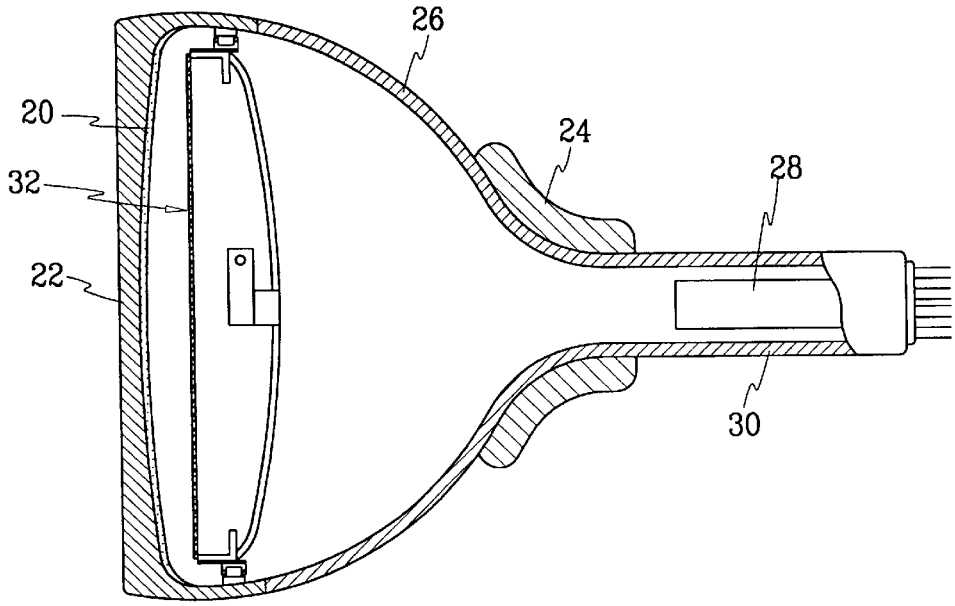
FIG. 1 is a side sectional view of a cathode ray tube where a color selection apparatus is employed, in accordance with the principles of the present invention.

FIG. 1 is a side sectional view of a cathode ray tube where a color selection apparatus is employed, in accordance with the principles of the present invention. As shown in the drawing, a cathode ray tube comprises a panel 22 on which a phosphor screen 20 is formed, a funnel 26 connected to the panel 22, and a neck 30 connected to the funnel 26. A deflection yoke 24 is mounted around the funnel 26, and an electron gun 28 for emitting electron beams is mounted in the neck 30.

The outer surface of the panel 22 is designed to be flat while the inner surface thereof is curved in a predetermined curvature. A color selection apparatus 32 is disposed inside the panel 22 so as to select red (R), green (G), and blue (B) electron beams emitted from the electron gun 28. Such a color selection apparatus 32 will be described in more detail with reference to FIG. 2.

Figure 2:
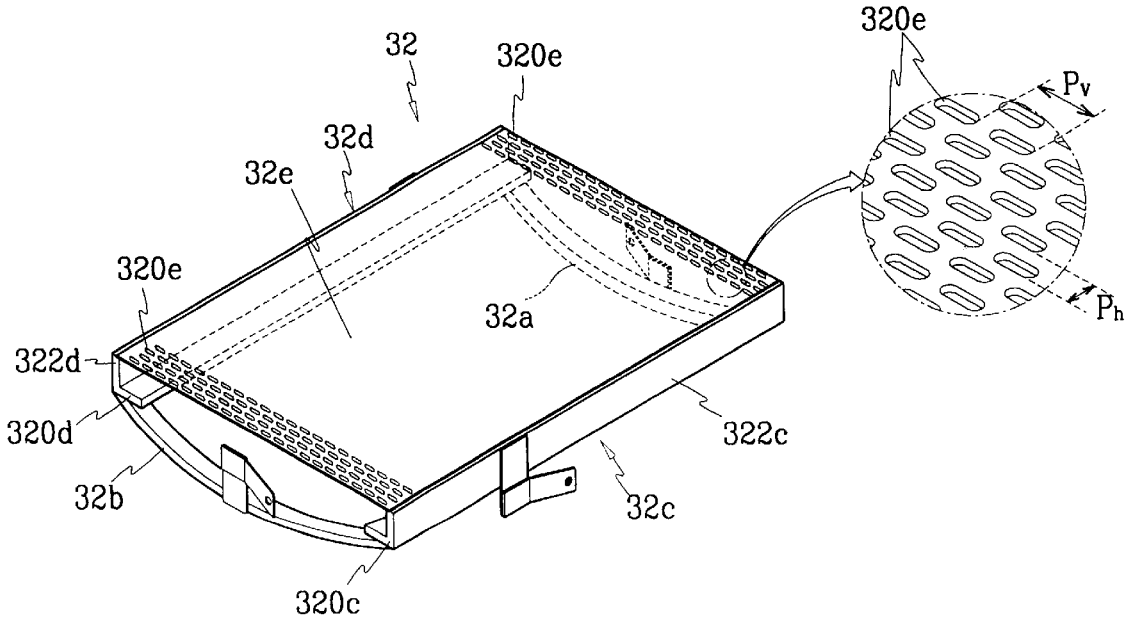
FIG. 2 is a perspective view of a color selection apparatus according to a first embodiment, in accordance with the principles of the present invention.

FIG. 2 is a perspective view of a color selection apparatus according to a first embodiment, in accordance with the principles of the present invention. As shown in FIG. 2, the color selection apparatus 32 comprises a pair of elastic members 32*a* and 32*b*, a pair of supporting members 32*c* and 32*d*, and a mask 32*e* having a plurality of electron beam-passing apertures 320*e*. The mask 32*e* is formed to be flat, and each of the apertures 320*e* is formed in a slot shape having a vertical pitch Pv at least five times higher than a horizontal pitch Ph. In other words, Pv is greater than or equal to 5 Ph.

The elastic members 32*a* and 32*b* and the supporting members 32*c* and 32*d* define a frame. That is, the elastic members 32*a* and 32*b* are laterally disposed in parallel and spaced at a predetermined distance from each other, and the supporting members 32*c* and 32*d* are longitudinally disposed in parallel and spaced at a predetermined distance from each other. The elastic members 32*a* and 32*b* are disposed between and connected to the supporting members 32*c* and 32*d*. Each of the elastic members 32*a* and 32*b* are arc-shaped having a predetermined curvature radius. Preferably, the curvature radius is about 800 to 10,000 mm, a range wherein the elastic members 32*a* and 32*b* maintain their effective tension. The elastic members 32*a* and 32*b* are arc-shaped and not U-shaped.

By defining the curvature radius of the elastic members 32*a* and 32*b* as described above, the elastic members 32*a* and 32*b* are reduced in their length, thereby reducing the weight of the cathode ray tube.

Figure 4:
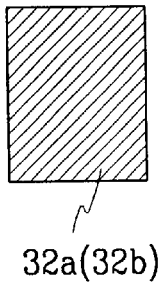
FIGS. 4 and 5 are sectional views illustrating different examples of an elastic member, in accordance with the principles of the present invention.
Figure 5:
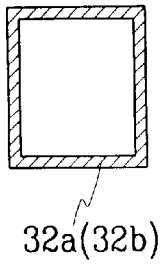

FIGS. 4 and 5 are sectional views illustrating different examples of an elastic member, in accordance with the principles of the present invention. As shown in FIGS. 4 and 5, each of the elastic members 32*a* and 32*b* is formed either as a solid rod (FIG. 4) or a tube (FIG. 5). When the elastic members 32*a* and 32*b* are formed as a tube, it is more preferable that the lateral section of the elastic member be formed in a square-shape.

Figure 3:
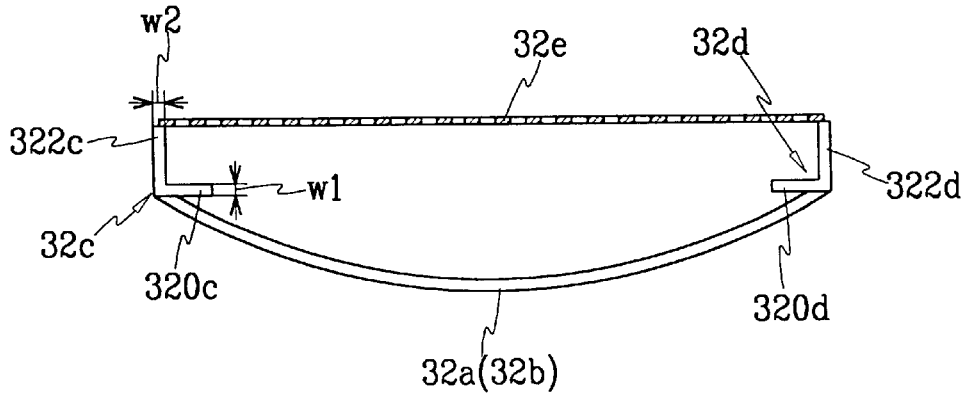
FIG. 3 is a side view of a color selection apparatus depicted in FIG. 2, in accordance with the principles of the present invention.

FIG. 3 is a side view of a color selection apparatus depicted in FIG. 2, in accordance with the principles of the present invention. As shown in FIG. 3, the supporting member 32*c* comprises a first plate 320*c* to which the elastic members 32*a* and 32*b* are attached and a second plate 322*c* extending from the first plate 320*c* at a predetermined angle and supporting the mask 32*e*.

Like the supporting member 32*c*, the supporting member 32*d* comprises a first plate 320*d* on which the elastic members 32*a* and 32*b* are attached and a second plate 322*d* extending from the first plate 320*c* at a predetermined angle and supporting the mask 32*e*.

The first embodiment of the present invention, as shown in FIGS. 2 and 3, is formed as follows. When attaching the elastic members 32*a* and 32*b* to the supporting members 32*c* and 32*d*, the supporting members 32*c* and 32*d* are disposed such that the second plates 322*c* and 322*d* are disposed at a right angle with respect to the mask 32*e*, and the elastic members 32*a* and 32*b* are attached to the bottoms of the first plates 320*c* and 320*d*.

Figure 6:
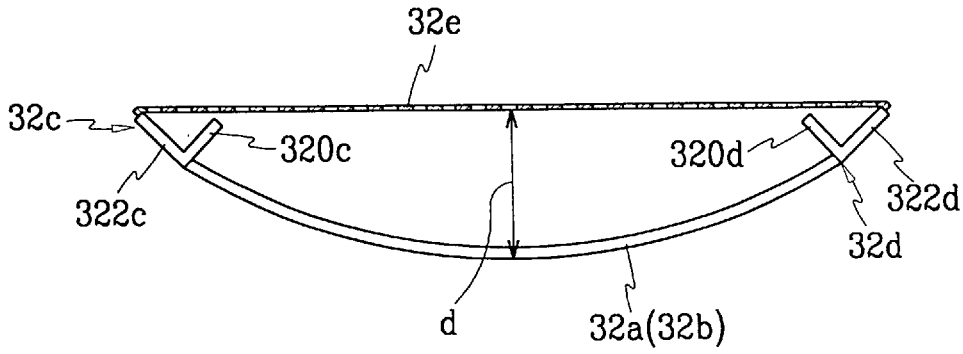
FIG. 6 is a side view of a color selection apparatus according to a second embodiment, in accordance with the principles of the present invention.

FIG. 6 is a side view of a color selection apparatus according to a second embodiment, in accordance with the principles of the present invention. The second embodiment of the present invention, as shown in FIG. 6, is formed as follows. The supporting members 32*c* and 32*d* may be disposed such that the second plates 322*c* and 322*d* are disposed on an identical curvature line extending from the curvature line of the elastic members 32*a* and 32*b*. In such a case, since the elastic force of the elastic members 32*a* and 32*b* is transmitted to the supporting members 32*c* and 32*d*, the mask 32*e* can be tensioned by the elastic force transmitted from the elastic members 32*a* and 32*b* as well as from the supporting members 32*c* and 32*d*. In addition, such a structure has an advantage in that the normal distance "d" from the mask 32*e* to the midpoint of the elastic member 32*a* (32*b*) can be reduced, thereby making it possible to reduce the whole depth of the cathode ray tube from the screen to the end of the neck.

In addition, as shown in FIG. 3, it is preferable that each thickness w1 of the first plates 320*c* and 320*d* be greater than each thickness w2 of the second plates 322*c* and 322*d*, in order to enhance the elastic of the supporting members 32*c* and 32*d*.

Furthermore, when the width of the second plates 322*c* and 322*d* is increased, the tension of the supporting members 32*c* and 32*d* can be effectively maintained and thus deformation can be prevented.

The mask 32*e* is formed to be flat and provided with a plurality of beam-passing apertures 320*e*, as shown in FIG. 2, for example. Each of the apertures 320*e* is formed in a slot-shape having a vertical pitch Pv at least five times higher than a horizontal pitch Ph.

Figure 7:
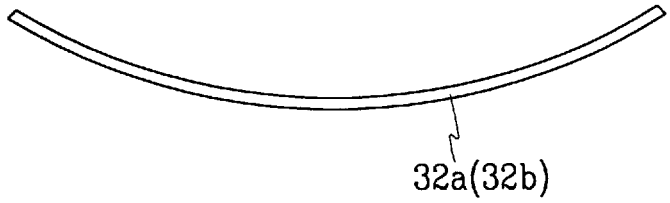
FIGS. 7 to 10 are schematic views illustrating the steps for manufacturing the color selection apparatus of FIG. 6, in accordance with the principles of the present invention.
Figure 8:
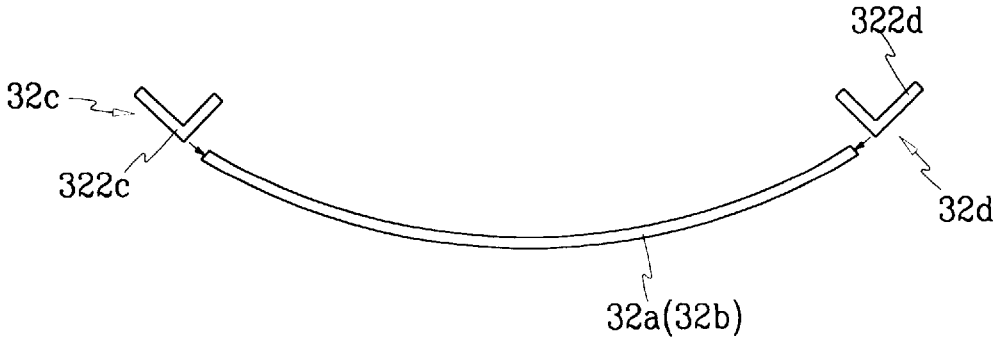

FIGS. 7 to 10 are schematic views illustrating the steps for manufacturing the color selection apparatus of FIG. 6, in accordance with the principles of the present invention. The elastic member 32*a* (32*b*) is first prepared as shown in FIG. 7, and then opposite ends of the elastic member 32*a* (32*b*) are respectively fixed on the second plates 322*c* and 322*d* of the supporting members 32*c* and 32*d* as shown in FIG. 8, in a state where the second plates 322*c* and 322*d* are disposed on the identical curvature line extending from the curvature line of the elastic member 32*a* (32*b*).

Figure 9:
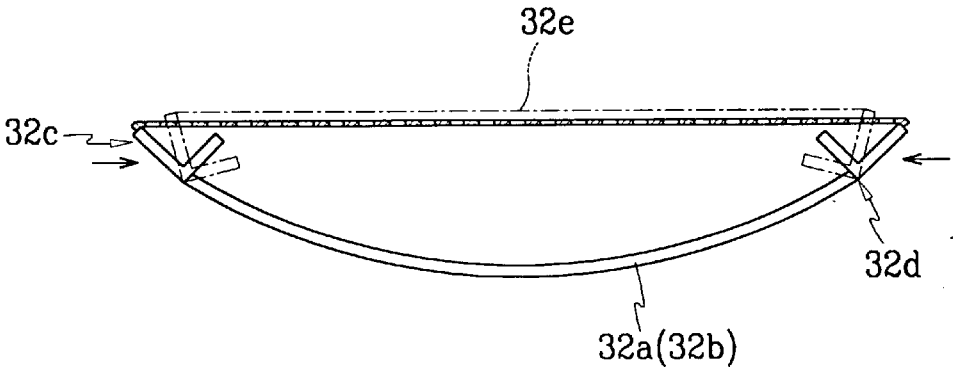

Next, as shown in FIG. 9, the mask 32*e* is welded on the second plates 322*c* and 322*d* of the supporting members 32*c* and 32*d* in a state where the supporting members 32*c* and 32*d* are pushed toward each other by a pressure apparatus (not shown).

Figure 10:
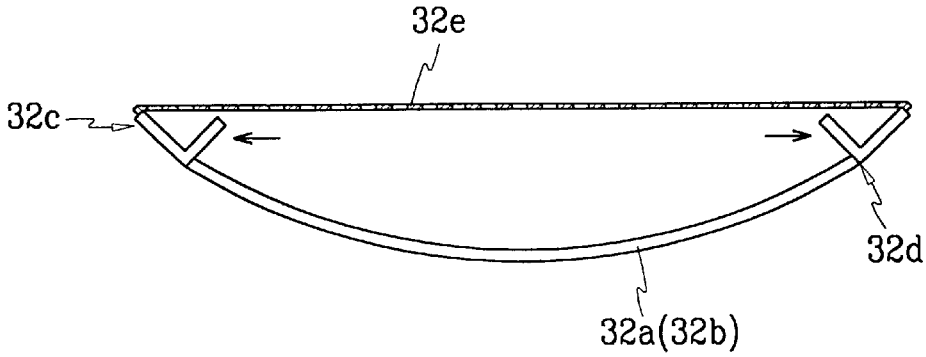

After the above steps are performed, the pushing force applied to the supporting members 32*c* and 32*d* is released. When the pushing force applied to the supporting members 32*c* and 32*d* is released, the supporting members 32*c* and 32*d* are returned to their initial position, as shown in FIG. 10. The mask 32*e* is tensioned by the elastic force formed by the elastic members 32*a* and 32*b* and the supporting members 32*c* and 32*d*, as shown in FIG. 10.

Figure 11:
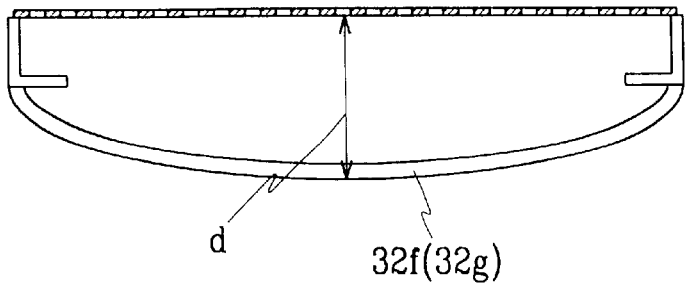
FIG. 11 is a side view of a color selection apparatus according to a third embodiment, in accordance with the principles of the present invention.

FIG. 11 is a side view of a color selection apparatus according to a third embodiment, in accordance with the principles of the present invention. The third embodiment shown in FIG. 11 is similar, but not identical, to the first embodiment shown in FIG. 2. The color selection apparatus of the third embodiment is similar to that of the first embodiment, except for the structure of the elastic members.

Each one of the elastic members 32*f* and 32*g* of the third embodiment, as shown in FIG. 11, is formed in a semi-elliptical shape. Thus, the third embodiment of the present invention has elastic members formed in a semi-elliptical shape, whereas the first embodiment of the present invention has elastic members formed in an arc shape.

As shown in FIG. 1, the central section of each elastic member has a curvature radius R1 corresponding to an arc-shape, and both end sections have a curvature radius R2 less than the curvature radius R1. Preferably, the curvature radius R1 is greater than 5 R. Note that R=1.767×a diagonal length of the effective screen of the cathode ray tube.

As described above, since the elastic member of the present invention is formed in a continuously nonlinear shape without any linear portion, it can be formed using less material than the U-shape elastic member depicted in FIG. 13.

When weight of a color selection apparatus employing the inventive elastic members is compared with that of a color selection apparatus employing the U-shaped elastic members, the weight of the former is less than that of the latter by about 0.39 kilograms (kg). This means that the elastic member formed in an arc-shape or a semi-elliptical-shape is very effective in reducing the whole weight of the color selection apparatus.

In the above, the weight of a first color selection apparatus is compared with the weight of a second color selection apparatus. The first color selection apparatus is formed according to the principles of the present invention, and it does not have U-shaped elastic members. The second color selection apparatus is not formed according to the principles of the present invention, and it does have U-shaped elastic members. The first and second color selection apparatuses are respectively applied to a cathode ray tube in which the screen size is 32 inches and the aspect ratio of the screen is 16:9.

In view of the above, the inventive color selection apparatus weighs less than other color selection apparatuses. Thus, the inventive color selection apparatus is an improvement over the other color selection apparatuses.

Furthermore, there are other advantages to the present invention. The elastic members of the present invention evenly distribute stress. However, the U-shaped elastic members do not evenly distribute stress.

When tension corresponding to that applied to the mask is applied to the elastic member of FIG. 13, the stress is concentrated on both bent portions of the U-shaped elastic member. However, when tension corresponding to that applied to the mask is applied to the elastic member of the present invention, the stress is uniformly distributed on the whole body of the inventive elastic member. This shows that the color selection apparatus employing the inventive elastic member has a high resistance to plastic deformation.

Figure 12:
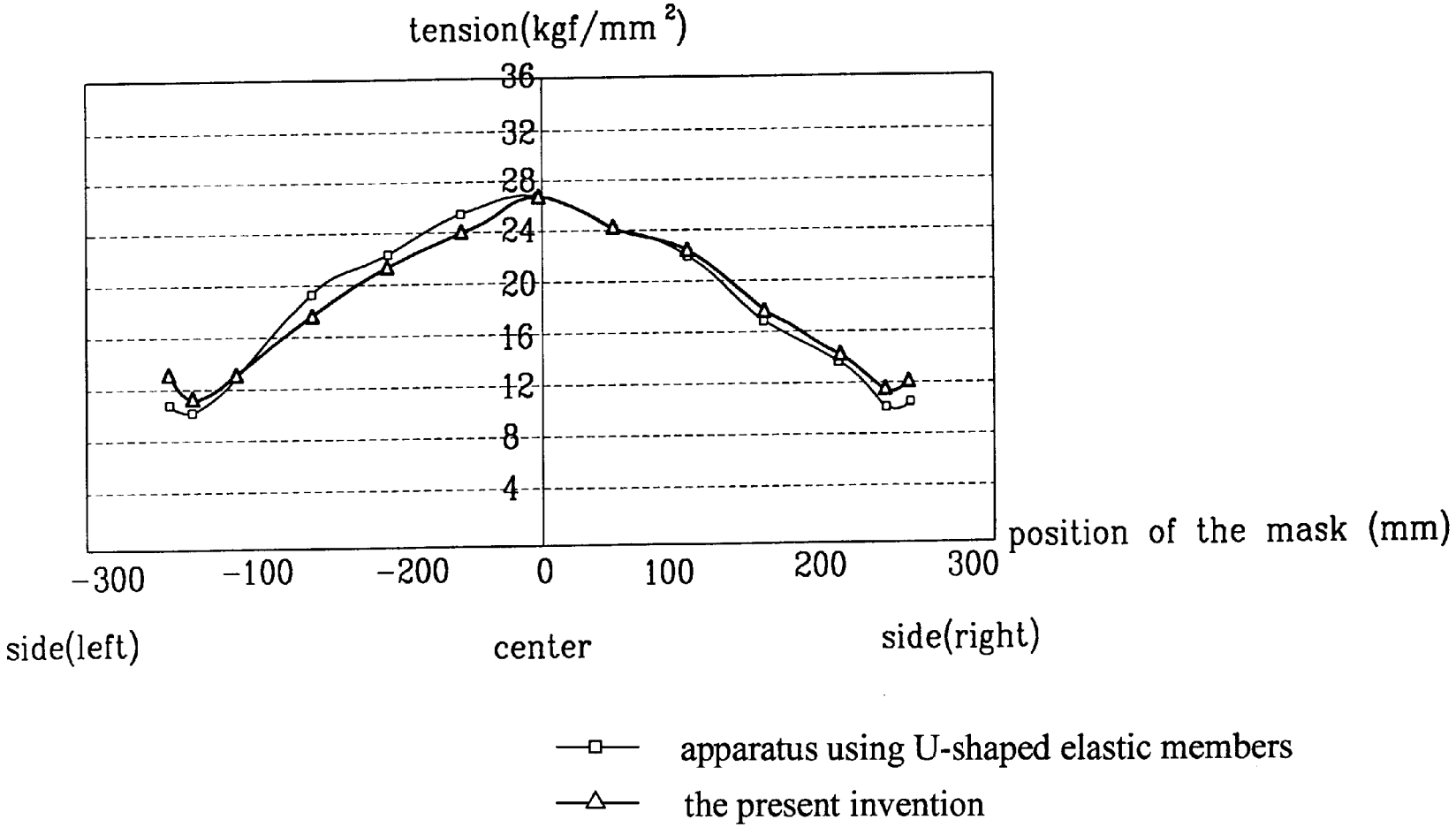
FIG. 12 is a graph for comparing tension distribution of a color selection apparatus of the present invention with that of the color selection apparatus shown in FIG. 13.

FIG. 12 is a graph for comparing tension distribution of a color selection apparatus of the present invention with that of the color selection apparatus shown in FIG. 13. As shown in the graph of FIG. 12, the tension distribution of the mask employing the present invention is similar to, but not identical to, the tension distribution of the mask employing the "U" shaped elastic members (shown in FIG. 13). As shown in FIG. 12, the tension distribution of the present invention is more uniform than the tension distribution of a mask using "U" shaped elastic members.

Although FIG. 2 shows two supporting members and shows two elastic members, the principles of the present invention are not restricted to devices having exactly two supporting members and exactly two elastic members. Other quantities of supporting members and elastic in members can be used advantageously, in accordance with the principles of the present invention.

FIG. 6 shows that the second embodiment of the present invention includes an elastic member 32*a*. Also shown in FIG. 6 are the supporting members 32*c* and 32*d*. The elastic member 32*a* is shown to consist of a continuously nonlinear shape. In other words, the elastic member 32*a* is shown to be a continuous curve shape. The elastic member 32*a* does not have any sharp corners. The elastic member 32*a* does not have a U-shape. The elastic member 32*a* does not have any linear portion in the direction from the supporting member 32*c* to the supporting member 32*d*. The entire length of elastic member 32*a* consists of a curve shape, with no straight portions.

However, the apparatus shown in FIG. 13 is very different from the apparatus shown in FIG. 6. The apparatus shown in FIG. 6 is formed in accordance with the principles of the present invention. On the contrary, the apparatus shown in FIG. 13 is not formed in accordance with the principles of the present invention.

The apparatus shown in FIG. 13 includes an elastic member 10 that does not have a continuously nonlinear shape. The elastic member 10 is not a continuous curve shape. The elastic member 10 is formed to have some corners, so that the elastic member 10 exhibits a U-shape overall. The elastic member 10 has three linear portions and two curved portions, in the direction from the supporting member 14 to the supporting member 16. In other words, the elastic member 10 of FIG. 13 has a long straight central portion, and two short straight end portions. Two curve portions separate the short straight end portions from the long straight central portion.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. A color selection apparatus for a cathode ray tube, the apparatus comprising:

a pair of supporting members;

a pair of elastic members, each elastic member being disposed between and connected to said supporting members, said elastic members being formed in a continuously nonlinear shape; and a mask being coupled to said supporting members, said mask forming a plurality of beam-passing apertures.

2. The apparatus of claim 1, each one of said elastic members being formed in an arc-shape.

3. The apparatus of claim 1, each one of said elastic members being formed in a semi-elliptical-shape.

4. The apparatus of claim 1, each one of said elastic members being formed of a solid rod.

5. The apparatus of claim 1, each one of said elastic members being formed of a tube.

6. The apparatus of claim 5, each one of said elastic members having a lateral section formed in a square-shape.

7. The apparatus of claim 1, each one of said supporting members comprising:

a first plate being coupled to said elastic members; and a second plate extending from said first plate at a predetermined angle, said second plate being coupled to said mask, said second plate being disposed on an identical curvature line extending from a curvature line formed by said continuously nonlinear shape of said elastic members.

8. A cathode ray tube, comprising:

a panel having an inner surface with a phosphor screen formed at said inner surface;

a funnel being connected to said panel;

a neck being connected to said funnel; and a color selection apparatus being disposed adjacent to said inner surface of said panel to select electron beams emitted from an electron gun, said color selection apparatus comprising:

a first supporting member;

a second supporting member;

a pair of elastic members, each one of said elastic members being disposed between and connected to said first and second supporting members, each one of said elastic members being formed in a continuously nonlinear shape in a direction from said first supporting member to said second supporting member; and a mask being coupled to said first and second supporting members, said mask forming a plurality of beam-passing apertures.

9. The cathode ray tube of claim 8, each one of said elastic members being formed in an arc shape.

10. The cathode ray tube of claim 8, each one of said elastic members being formed in a semi-elliptical shape.

11. The cathode ray tube of claim 8, said panel comprising an outer surface and said inner surface, said outer surface being flat, said inner surface being curved in a predetermined curvature.

12. A color selection apparatus for a color cathode ray tube, the apparatus comprising:

a frame, comprising:

a pair of supporting members being disposed in parallel and spaced away from each other; and a pair of elastic members being disposed between and coupled to said supporting members, each one of said elastic members having a central section and two end sections adjacent to said central section, said central section having a first curvature radius, said two end sections having a second curvature radius different from said first curvature radius; and a mask being coupled to said supporting members and provided with a plurality of beam-passing apertures.

13. The apparatus of claim 12, each one of said supporting members comprising:

a first plate coupled to said elastic members; and a second plate extending from said first plate at a predetermined angle and being coupled to said mask, said second plate being disposed on an identical curvature line extending from a curvature line of said end sections of said elastic members.

14. The apparatus of claim 12, said first curvature radius of said central sections being about 800 to 10,000 millimeters.

15. The apparatus of claim 12, said first curvature radius being larger than said second curvature radius.

16. An apparatus, comprising:

a plurality of supporting members, said plurality of supporting members including at least a first supporting member and a second supporting member;

at least one elastic member, said elastic member being disposed between and connected to said first and second supporting members, said at least one elastic member being formed in a continuously nonlinear shape in a direction from said first supporting member to said second supporting member; and a mask being coupled to said first and second supporting members, said mask forming a plurality of beam-passing apertures.

17. The apparatus of claim 16, said first supporting member comprising:

a first plate being coupled to said at least one elastic member; and a second plate extending from said first plate at a predetermined angle, said second plate being coupled to said mask, said second plate being oriented to extend in a direction of a curvature line formed by said continuously nonlinear shape of said at least one elastic member.

18. The apparatus of claim 17, said continuously nonlinear shape corresponding to one shape selected from among an arc and a portion of an ellipse, said at least one elastic member being formed of one selected from a solid rod and a tube.

19. The apparatus of claim 18, said at least one elastic member having a lateral section formed in a square shape.

* * * * *